US007036191B2

(12) United States Patent
Tsaur

(10) Patent No.: US 7,036,191 B2
(45) Date of Patent: May 2, 2006

(54) LOWER STOP OF ZIPPER

(76) Inventor: Chang-Wen Tsaur, 235 Chung-Ho Box 8-24, Taipei (TW)

( * ) Notice: Subject to any disclaimer, the term of this patent is extended or adjusted under 35 U.S.C. 154(b) by 257 days.

(21) Appl. No.: 10/421,165

(22) Filed: Apr. 21, 2003

(65) Prior Publication Data

US 2004/0205942 A1 Oct. 21, 2004

(51) Int. Cl.
*A44B 19/38* (2006.01)

(52) U.S. Cl. ..... 24/433
(58) Field of Classification Search ..... 24/433–435, 24/388
See application file for complete search history.

(56) References Cited

U.S. PATENT DOCUMENTS 2,300,369 A * 10/1942 Kellum ..... 24/433
3,170,207 A * 2/1965 Morin ..... 24/433
3,922,761 A * 12/1975 Schwendt ..... 24/434
4,441,235 A * 4/1984 Kusayama ..... 24/433
5,231,737 A * 8/1993 Frohlich et al. ..... 24/434

FOREIGN PATENT DOCUMENTS

GB 1339303 A * 12/1973

* cited by examiner

*Primary Examiner*—James R. Brittain

(57) ABSTRACT

A lower stop of a zipper comprises a male stop formed by a lower portion and a high portion. An upper inner side of the lower portion has a downward hook and an upper top of the hook has a recess. One side of the recess has a stopper. A lower end of the downward hook is formed with an inclined groove; and a female stop has a buckle at an upper portion thereof and a block-like embedded seat at a lower portion thereof. An inner lateral wall of a top of the buckle is an upward protrusion and an upper side of the upward protrusion has cambered slot. An embedded groove penetrates through the embedded seat. An inner lateral wall of the embedded seat has a sliding groove which is communicated with the embedded groove.

4 Claims, 8 Drawing Sheets

LOWER STOP OF ZIPPER

FIELD OF THE INVENTION

The present invention relates to zippers, and particularly to a lower stop of a zipper which can suffer from a larger force, including vertical force or forces applied from two sides. The lower stop can suffer from a pull force of 15 kg/cm$^2$ so as to achieve the object of releasing—prevention. The sliding groove of the embedded seat of the female stop has a stop block so that as the embedded seat is clamped at two sides, the stop block has the effect of breaking-prevention.

BACKGROUND OF THE INVENTION

Referring to FIG. 8, a prior art zipper is illustrated. In this prior art, the lower stop has a block 81 and a pin 82. Moreover, in FIG. 9, another prior art zipper is illustrated. The lower stop of the zipper has a block 91 and a pin 92. For the prior art shown in FIG. 9, the block 91 has a channel 911 for fixing a lower portion 926 of a pin 92. An upper end of the block 91 has a buckle 912 which can be buckled into the high portion 927 of the pin 92. The feature of the prior art is that an inner lateral wall of the high portion is installed with a longitudinal rib 925. A buckling groove 914 formed by two tenons 913 at an inner surface of the buckling portion 912 so as to achieve the function of retaining and releasing-proof.

Referring to FIG. 10, it is illustrated the defect of the prior art. In the prior art zipper, the lower stop 9 can be used to Nylon zipper or plastic steel zipper, wherein the block 91 and the pin 92 are installed at a lower end of the chain tooth 93 and are fixed to the inner lateral sides of the left and tight teeth strips 94. A lower end of the pin 92 has inclined edges 921 and 922 at two sides thereof. Thereby, the lower end can be inserted into the channel 911. However only the tapered edge 923 at the upper end of the inclined surface 922 is in contact with the inner wall of the channel 911. Further, the buckling portion 912 of the block 91 has two tenons 913 at inner wall of the upper end thereof. The two tenons 913 can engage the longitudinal rib 925 at the inner wall of the pin 92. Besides, a top of the pin 92 has a recess 924 for guiding the tooth head 931 of the chain tooth 93.

With reference to FIG. 11, a schematic view showing the lower stop of the prior art zipper suffers from a force. In general, the lower stop must suffer from a pull force of 9 kg/cm$^2$ (which is art international standard). The pull force can be divided into a vertical pull force, an upper pull force, a lower pull force and a lateral pull force. In general, the lower stop can match the standard. However because some nations adapts a high standard (15 kg/cm$^2$), the lower stop can not match this standard. Especially, the lateral pull force can not match this standard. This is because when the strips 94 are pulled by lateral forces (as indicated by arrows), in the pin 92 of the lower stop, only the projection 923 and the recess 924 suffer from pull forces. Although the recess 924 is stopped by the tooth head 931 of the chain tooth, the chain tooth 93 will extend due to the action of the chain strips 94 so as to move abnormally. When the applied force is larger, the tooth head 931 will separate from the recess 924 so that the pin 91 releases. When the applied force is larger, the tooth head 931 will release from the recess 924. As a result, the upper end of the pin 91 is released to move outwards. Next, the projection 923 at the lower end displaces inwards after it displaces outwards at an upper end of the pin 91 so that the projection 923 releases from an upper end of the channel 911. Thereby, the pin 91 releases, rotates and looses.

With reference to FIG. 12, an inner side of the channel 911 of the block 91 is installed with a sliding groove 915, the sliding groove 915 will cause the inner side of the block 91 can not suffer from a vertical clamping force (as shown by the arrow). Therefore the inner side of the block 91 breaks from the portion between the middle line 916 (indicated by the dashed line) and the channel so that the lower stop can not be used.

SUMMARY OF THE INVENTION

Accordingly, the primary object of the present invention is to provide a lower stop of a zipper which comprises a male stop formed by a lower portion and a high portion; an upper inner side of the lower portion has a downward hook and an upper top of the hook has a recess; one side of the recess has a stopper; a lower end of the downward hook is formed with an inclined groove; and a female stop having a buckle at an upper portion thereof and a block-like embedded seat at a lower portion thereof; an inner lateral wall of a top of the buckle is an upward protrusion and an upper side of the upward protrusion has cambered slot; an embedded groove penetrates through the embedded seat; an inner lateral wall of the embedded seat has a sliding groove which is communicated with the embedded groove.

The various objects and advantages of the present invention will be more readily understood from the following detailed description when read in conjunction with the appended drawing.

BRIEF DESCRIPTION OF THE PREFERRED EMBODIMENTS

The present invention will be described herein by using preferred embodiment with reference to the appended drawings.

Figure 1:
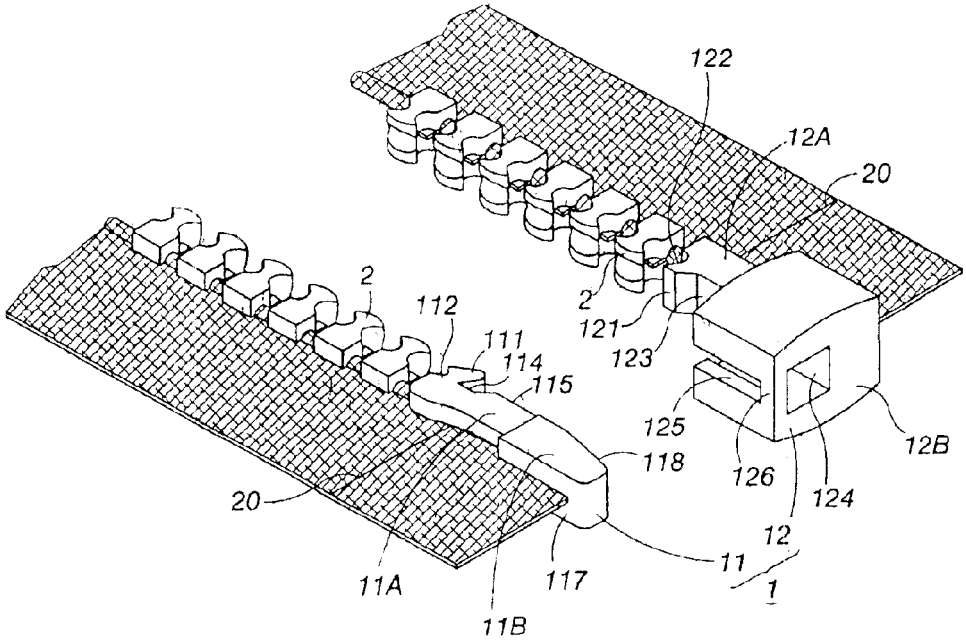
FIG. 1 is a perspective view showing that the lower stop is not closed.
Figure 2:
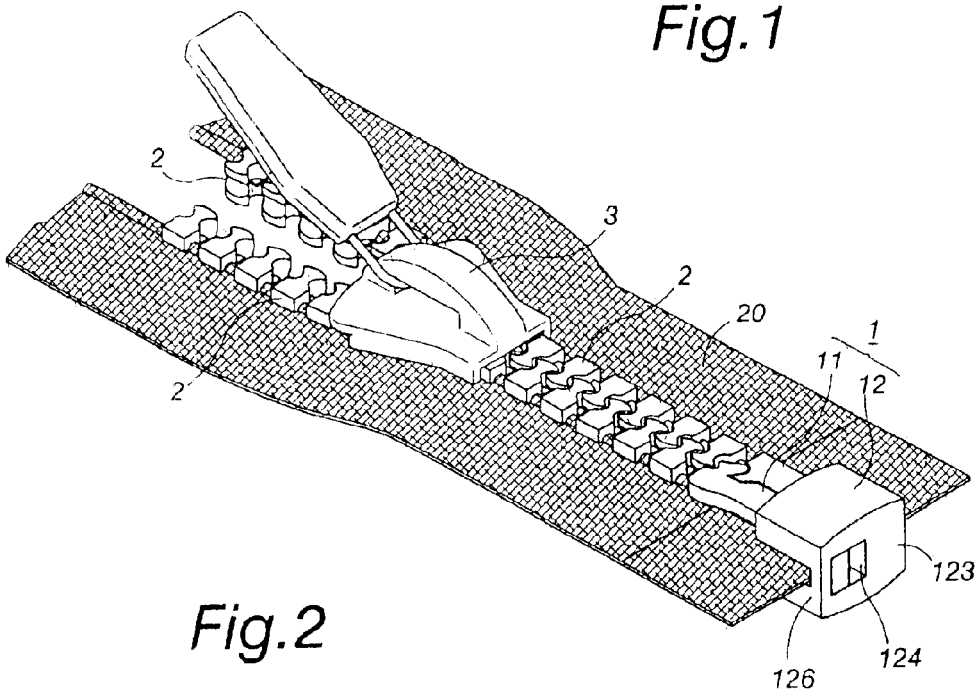
FIG. 2 is a perspective view showing that the lower stop is closed.

FIG. 1 is a perspective view of the present invention before the lower stop 1 is closed is illustrated. In the drawing, the lower stop 1 is arranged at lower ends of two strips 20 as a sealing element for sealing two teeth banks 2. The lower stop 1 includes a male stop 11 and a female stop 12. By the male stop 11 and female stop 12 to seal the lower end of the teeth banks 2, the pull 3 will not separate from the strips 20.

Figure 3A:
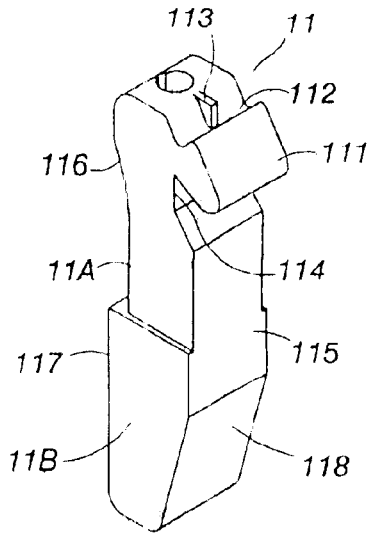
FIG. 3A is a perspective view showing the male stop and female stop of the present invention.
Figure 3B:
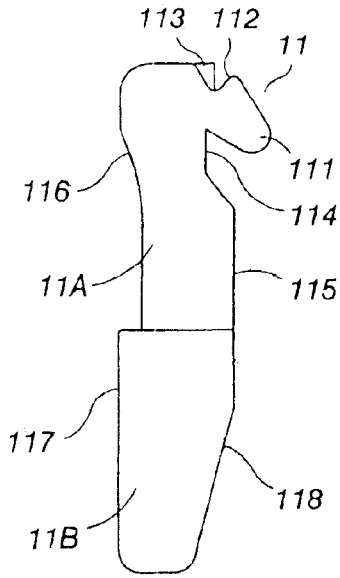
FIG. 3B is a plane schematic view showing the plane of the male stop of the lower stop.

Referring to FIGS. 3A and 3B, it is illustrated that the upper portion of the male stop 11 is formed by a lower portion 11A and a high portion 11B. An upper inner side of the lower portion 11A has a downward hook 111 and an upper top thereof has a recess 112. One side of the recess 112 has a stopper 113. A lower end of the downward hook 111 is formed with an inclined groove 114 and the inner lateral wall of the lower portion 11A is a vertical plane and the outer lateral wall 116 is a cambered surface. Moreover, the outer lateral wall 117 of the high portion 11B of the male stop 11 is a vertical plane and the inner lateral wall is an inclined plane 118.

Figure 4A:
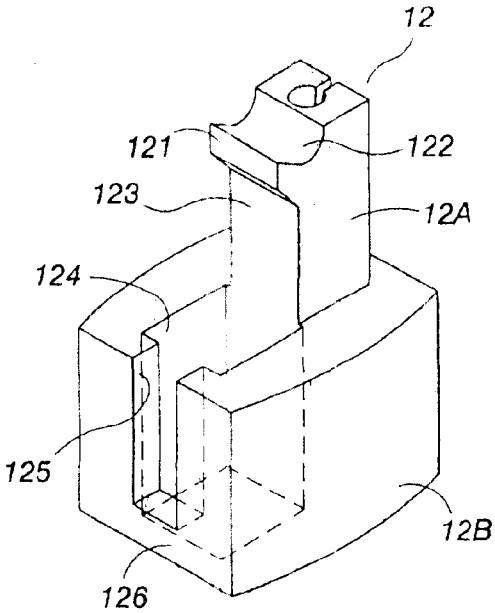
FIG. 4A is a perspective View showing the female stop of the lower stop of the present invention.
Figure 4B:
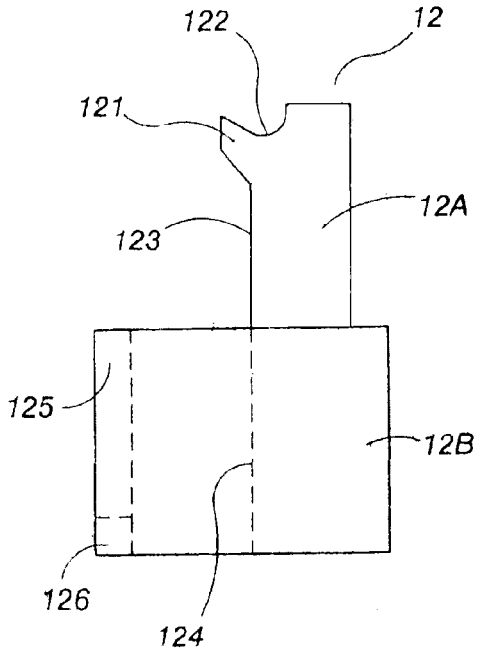
FIG. 4B is a plane schematic view showing the female stop of the lower stop of the present invention.

Referring to FIGS. 4A and 4B, it is illustrated that the female stop 12 is a buckle 12A and a lower portion is a block-like embedded seat 12B. An inner lateral wall of a top of the buckle 12A is an upward protrusion 121 and an upper side of the upward protrusion 121 has a cambered slot 122. An inner lateral wall 123 of the lower end of the protrusion 121 is a vertical plane. An embedded groove 124 penetrates through the embedded seat 12B. An inner lateral wall of the embedded seat 12B has a sliding groove 125 which is communicated with the embedded groove 124. A lower end of the sliding groove 125 is integrally connected to the stopper block 126.

Figure 5A:
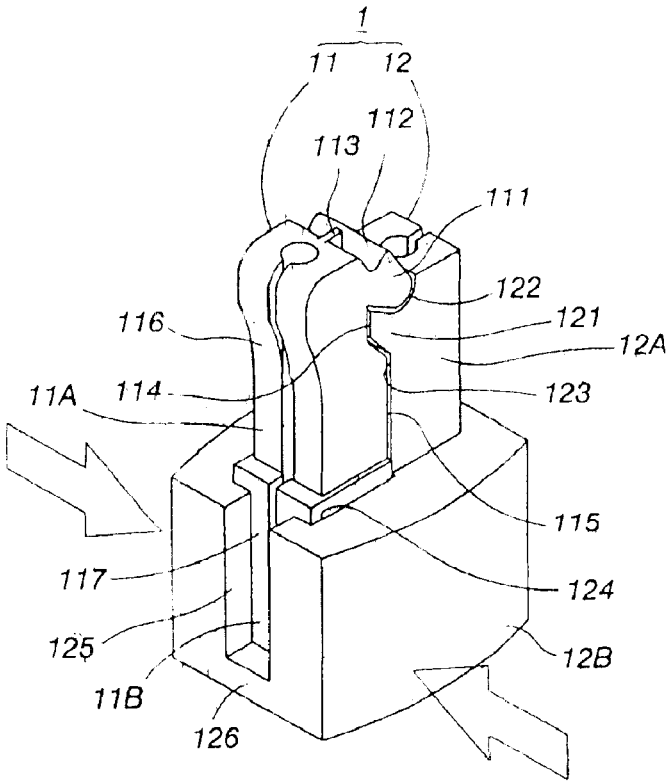
FIG. 5A shows the assembly of the male stop and female stop of the present invention.
Figure 5B:
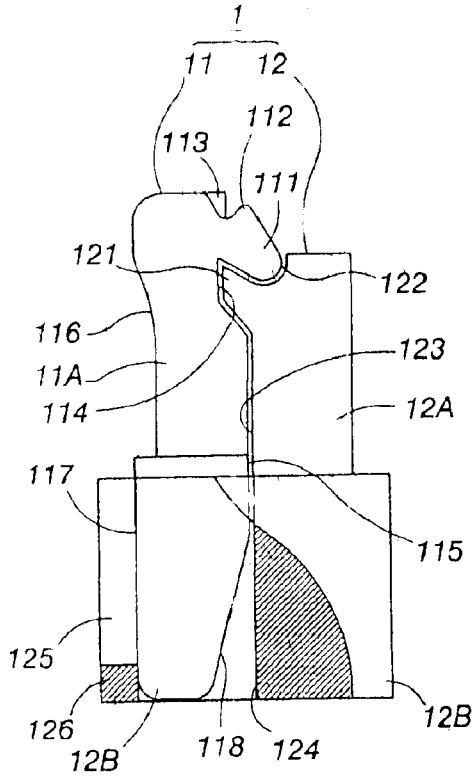
FIG. 5B is an assembled schematic view of the male stop and female stop of the present invention.

Referring to FIGS. 5A and 5B, the engagement of the male stop 11 and female stop 12 are illustrated. The male stop 11 enters into the embedded groove 124 from an inner lateral inclined surface 118 of the high portion 11B. Then the vertical outer lateral wall 117 is in contact with the inner wall of the embedding groove 124 The vertical inner wall 115 is in contact with the vertical inner lateral wall 123 of the buckle 12A. The teeth strip 20 connected to the male stop 11 can be guided out from the sliding groove 125. The hook 111 is embedded into the slot 122. The protrusion 121 inserts into the embedded groove 114. Thereby, when the male stop 11 and female stop 12 are engaged, a stable structure is achieved. In above description, the cambered outer lateral wall 116 of the lower portion 11A of the male stop 11 has a preferred plasticity. In the high portion 11B, the inner lateral wall and outer lateral wall are tightly engaged to the inner wall of the embedded groove 124 of the embedded seat 12B. Thereby, the stability is high. Moreover, stopper block 126 of the female stop 12, the embedded seat 12B can suffer the clamping forces from two sides (indicated by the arrow shown in FIG. 5A) so as to prevent from breaking or damage. Thus the stopper block 126 can be used as an enhancing block.

Figure 6A:
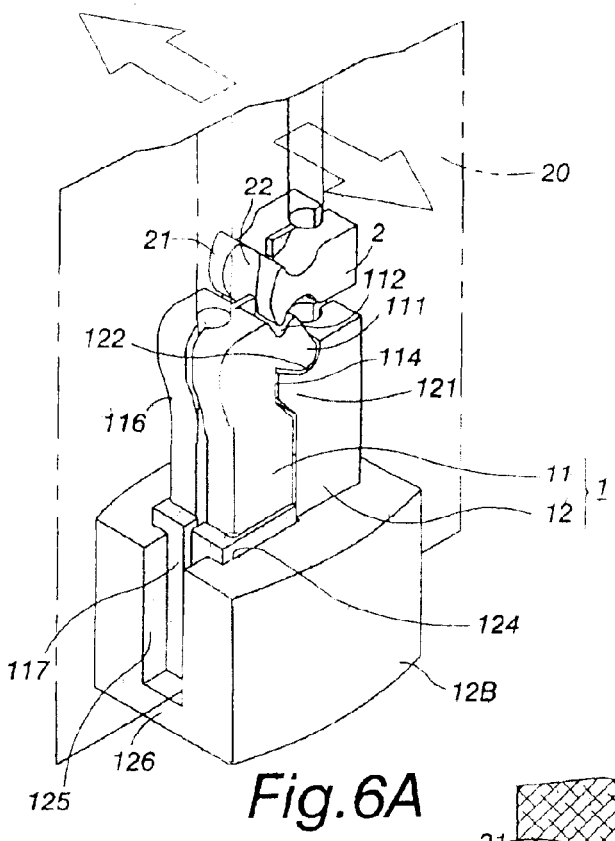
FIG. 6A is a perspective view showing the arrangement of the lower stop and a teeth strip.
Figure 6B:
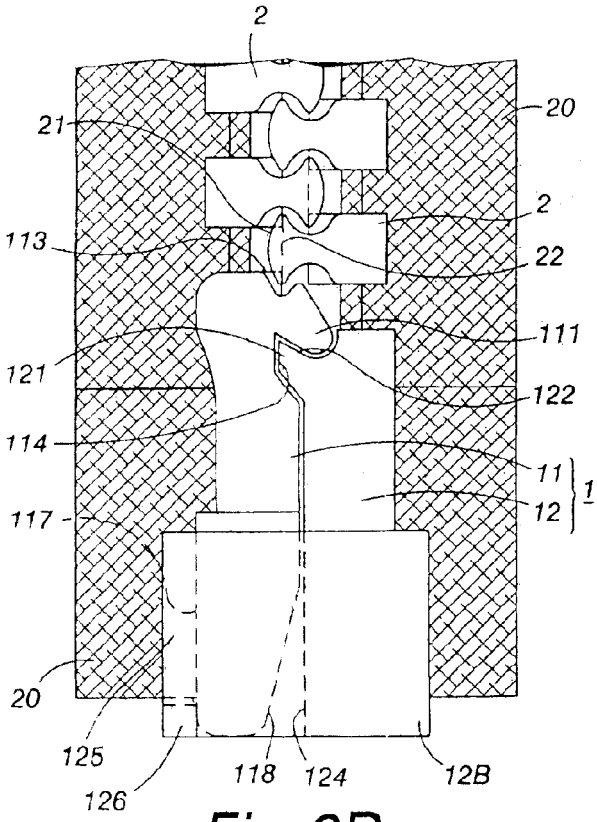
FIG. 6B is a plane schematic view showing the arrangement of the lower stop and a teeth strip.

With reference to FIGS. 6A and 6B, it is illustrated that the recess 112 at the top of the male stop 11 can be embedded by the teeth head 21, and the stopper 113 in the recess 112 can be engaged to the tooth recess 22 of the teeth head 21. Thus a vertical pull force is prevented (referring to FIG. 6A).

Figure 7:
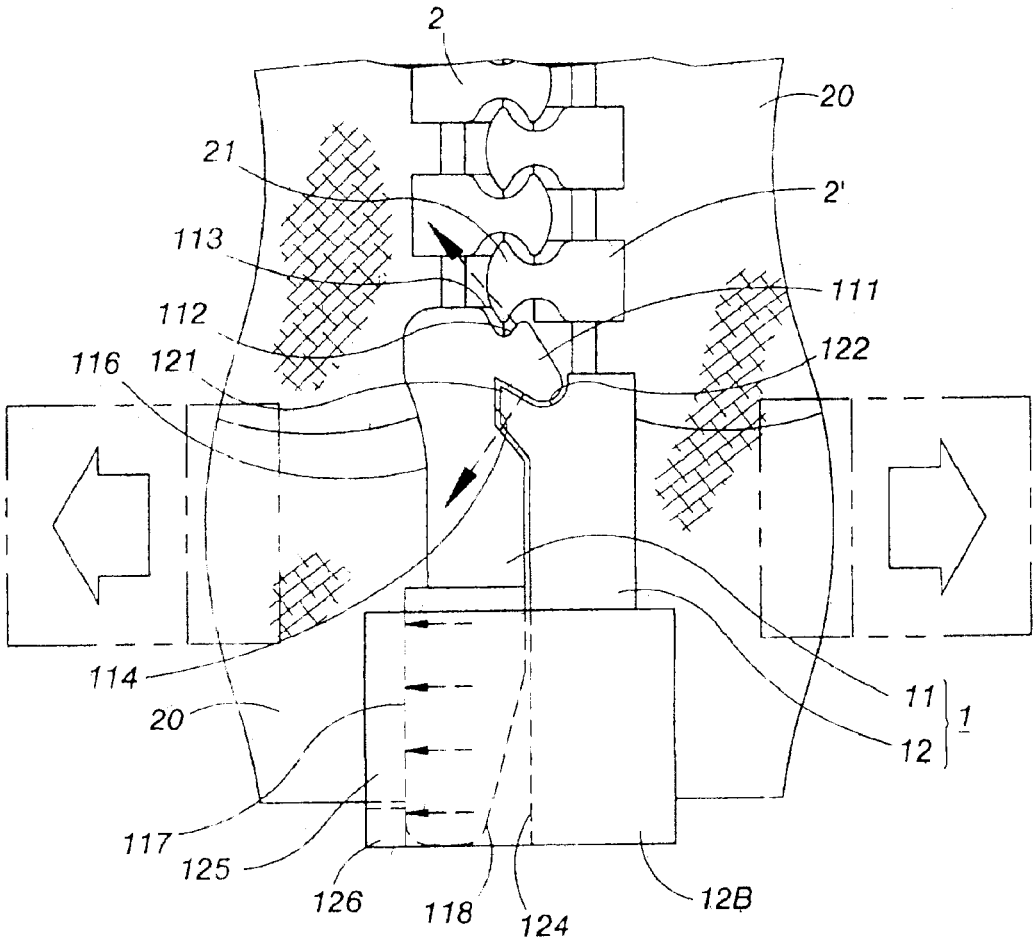
FIG. 7 is a schematic view showing that the lower stop of the present invention is suffered from a lateral force.
Figure 8:
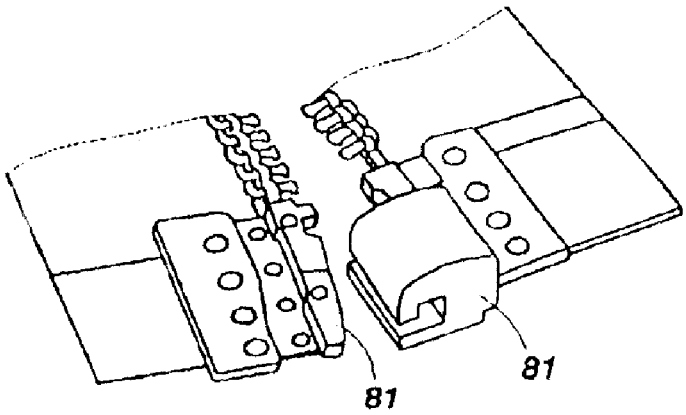
Fig.8 (Prior Art)
FIG. 8 is a perspective view showing a zipper in one prior art.
Figure 9:
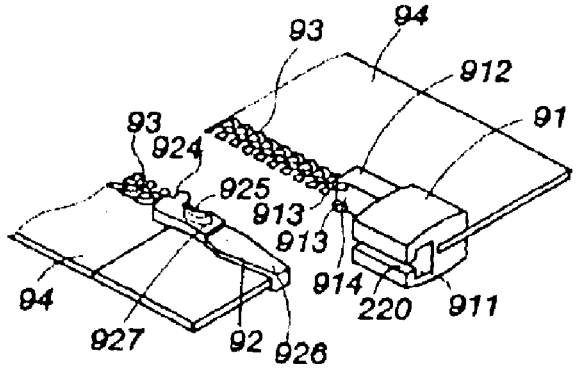
Fig.9 (Prior Art)
FIG. 9 is a perspective view showing the zipper in another prior art.
Figure 10:
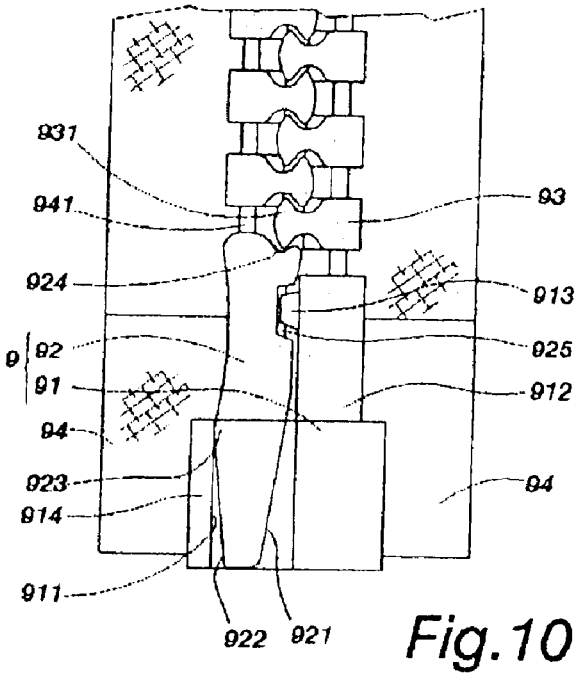
Fig.10 (Prior Art)
FIG. 10 is a plane assembly view of the lower stop in FIG. 9.
Figure 11:
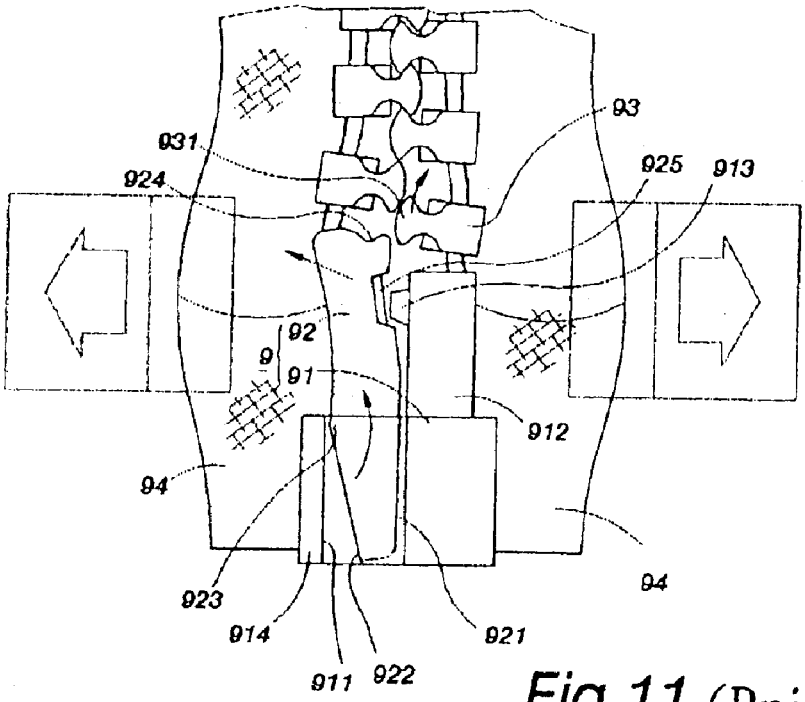
Fig.11 (Prior Art)
FIG. 11 is a schematic view showing the lower stop of FIG. 9 suffers from a lateral force.
Figure 12:
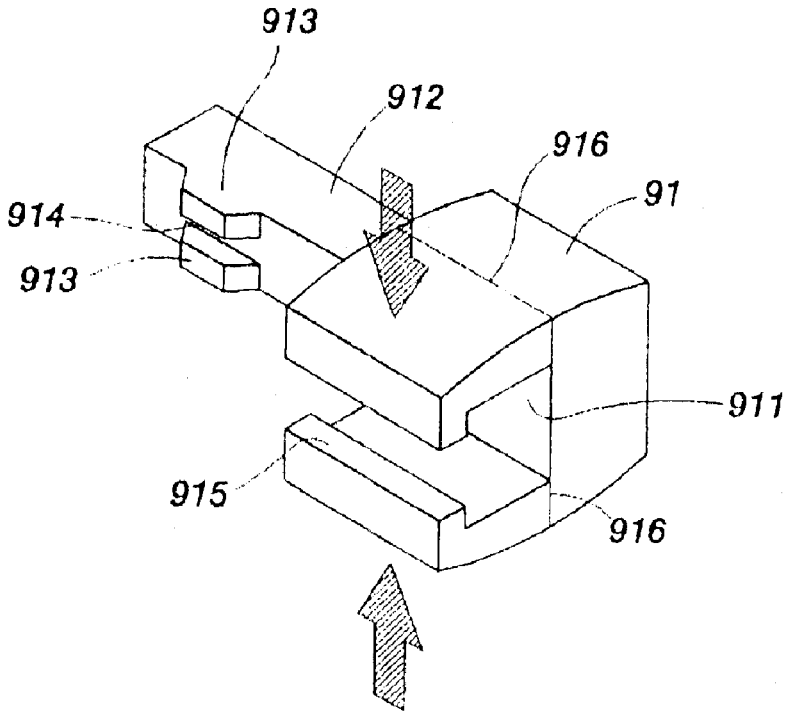
Fig.12 (Prior Art)
FIG. 12 is a schematic view showing the lower stop of FIG. 9 is clamped.

Referring to FIG. 7, when the male stop 11 and female stop 12 are combined, a lateral pull force (as shown by the arrow) is applied. Then other than the engagement of the recess 112 and the teeth bank, 2', by the engagement of the slot 122 with the hook 111 and the engagement of the embedded groove 114 and the protrusion 121, the force applied area at the upper end of the lower stop 1 is fixed firmly. By the arrangement of the walls 115, 117 of the lower end of the male stop 11 and the embedded groove 124, the force applied area is increased. As a result, the load is reduced and the force applied is also reduced. Since the upper end of the upper stop does not become loose and the lower end thereof is firmly secured. Thus the lower stop 1 can suffer from a great pull force or pressure and thus will not release out.

Advantages of the present invention is that the zipper with the design of the present invention can suffer from a larger force, including vertical force or forces applied from two sides. The lower stop can suffer from a pull force of 15 $kg/cm^2$ so as to achieve the object of releasing—prevention. The sliding groove of the embedded seat of the female stop has a stop block so that as the embedded seat is clamped at two sides, the stop block has the effect of breaking-prevention.

The present invention is thus described, it will be obvious that the same may be varied in many ways. Such variations are not to be regarded as a departure from the spirit and scope of the present invention and all such modifications as would be obvious to one skilled in the art are intended to be included within the scope of the following claims.

What is claimed is:

1. A lower stop of a zipper comprising:

a male stop formed by a lower portion and a high portion; an upper inner side of the lower portion having a downwards extended hook and an upper top of the hook having a recess; one side of the recess having a stopper; a lower end of the book being formed with an inclined groove; and a female stop having a buckle at an upper portion thereof and a block-like embedded seat at a lower portion thereof; an inner lateral wall of a top of the buckle being protruded with an upward protrusion and an upper side of the upward protrusion having a cambered slot; an embedded groove penetrating through the embedded seat; an inner lateral wall of the embedded seat having a sliding groove which is communicated with the embedded groove; and wherein an outer wall of the lower portion of the male stop is a concave cambered surface.

2. The lower stop of a zipper as claimed in claim 1, wherein the stopper of the male stop is at a lateral side; and a teeth recess of a first teeth strip is engaged to the stopper.

3. The lower stop of a zipper as claimed in claim 1, wherein an inner wall of the high portion of the male stop has an inclined surface so that it can be guided into the embedded groove of the embedded seat and an outer wall thereof is a vertical plane which is in surface-contact with an inner wall of the embedded groove of the female stop.

4. The lower stop of a zipper as claimed in claim 1, wherein a lower end of the sliding groove of the female stop is connected with a stop block.

* * * * *